United States Patent [19]

Schroeder et al.

[11] Patent Number: 4,982,058

[45] Date of Patent: Jan. 1, 1991

[54] SAFETY INTERLOCK SWITCH SYSTEM

[76] Inventors: Alfred A. Schroeder, 2811 Whisper Fawn, San Antonio, Tex. 78230; Robert W. Niedheiser, 14310 Stoddard, San Antonio, Tex. 78232

[21] Appl. No.: 439,489

[22] Filed: Nov. 21, 1989

[51] Int. Cl.[5] ..... H01H 3/16

[52] U.S. Cl. ..... 200/61.62; 200/61.76; 200/330

[58] Field of Search ..... 200/61.62, 61.76, 61.81, 200/61.82, 82 C, 330, 520, 573

[56] References Cited

U.S. PATENT DOCUMENTS

| | | | |
|---|---|---|---|
| 2,096,503 | 10/1937 | Allread | 200/61.82 |
| 3,143,611 | 8/1964 | Nansel | 200/61.82 |
| 3,261,958 | 7/1966 | Bittner | 200/330 |
| 3,737,607 | 6/1973 | Lawson | 200/330 |
| 4,138,603 | 2/1979 | Hudimac, Jr. | 200/330 |

*Primary Examiner*—J. R. Scott

*Attorney, Agent, or Firm*—Cox & Smith Incorporated

[57] ABSTRACT

An improved safety interlock switch device incorporated onto a machine with internal moving components. The device is mounted adjacent a cover which shields the internal components of the machine when the cover is in a closed position. When the cover breaks contact with the switch, electrical circuit controlling the internal moving components is broken such that movement ceases in the interior of the machine. This type of system protects operators who can be injured by moving internal components while also preventing destruction of the internal components caused by contact with external elements while still in motion. The present invention lengthens the time delay between the break in contact of the cover and the deactivation of the electrical circuit controlling power to the internal movable components.

2 Claims, 1 Drawing Sheet

SAFETY INTERLOCK SWITCH SYSTEM

BACKGROUND OF THE INVENTION

This invention relates to safety interlock switches which are designed to interrupt electrical circuit controlling internal moving components such that movement ceases when the interior of a machine is exposed. This type of system protects operators who can be injured by moving internal components while also preventing destruction of the internal components caused by contact with external elements while still in motion.

Safety interlock switches are ordinarily mounted adjacent removable lids, doors, or any type of cover and the like which, when opened, provide access into the interior of a machine, providing reach to internal components therein. When a cover is removed or opened, contact with the interlock switch is broken and the interlock switch is deactivated which breaks electrical circuit powering moving elements. When the cover is replaced and contact resumed, the electrical system is reactivated.

Conventional interlock switches are highly sensitive, having "travels" of about 1/25 to 1/16 of an inch. "Travel" is the margin of distance at which the switch will not deactivate when contact with a cover begins to break (also referred to as "play" when used in this context). This extremely limited travel available in conventional interlock switches causes problems with machines that have internal moving components which vibrate or rattle the entire apparatus. Vibrations and minute shiftings of a machine can inadvertently deactivate the interlock switch system due to its sensitivity. Any movement of a cover away from contact with an interlock switch that exceeds 1/16 of an inch travel can interrupt a machine's internal workings, bringing the activity to a halt. Operators faced with this dilemma have to constantly readjust covers to reactivate electrical circuit.

To illustrate this problem, one example is the use of safety interlock switches in storage apparatus in which internal moving components periodically shift stored items. As the stored contents are agitated, the cover is inadvertently pushed by the moving items. An interlock switch with limited travel distance mounted on such an apparatus will constantly deactivate the electrical system causing unnecessary cessation of the work activity of moving components and frustration to an operator faced with repeated stoppage.

One method that is currently being used to solve this problem is the use of leaf springs. Leaf springs are comprised of a flexible actuating arm connected to a pivot point. The flexible actuating arm is placed over a conventional interlock switch and interposed between the contact point of a cover and the switch. Since the cover and switch are separated by the actuating arm, the flexibility of the arm is intended to provide extra travel in an effort to extend the distance of actuation beyond the limited travel distances provided in the conventional interlock switch. The leaf springs are designed to push against the cover and the switch as the cover begins breaking contact in an attempt to delay deactivation.

Leaf springs can extend travel in interlock switches, but their endurance to repeated flexing over time is relatively low and have to be frequently replaced. Repeated bending of the actuating arms at pivot points causes loss of tension over relatively short periods of time. Furthermore, leaf springs have to be mounted off-center because the flexible actuating arm has to extend from its pivot point horizontally over an interlock switch causing complications in installment, especially since such installments have to be repeated frequently.

Another method of delaying actuation in interlock switches is the use of sophisticated magnetic sensing means. Magnetic sensors mounted to relevant machines are designed to detect breaks in contact between the cover and interlock switch and activate the switch through printed circuit logic if the travel exceeds a pre-programmed threshold distance. This threshold travel distance is programmed to be greater than the 1/16 of an inch available in conventional interlock switches. This type of system is relatively complicated and the costs of installing such a device is usually not justified. There is a need for an improved device which is of a simple construction for ease of incorporation into interlock switches and more economical in design to justify the amount of the return of adopting such an effort.

The present invention discloses a novel improvement over conventional interlock switch systems which can be cheaply incorporated with existing safety switches to create an economical and uncomplicated safety interlock switch mechanism.

It is an object of the present invention to provide an interlock switch system with increased travel distances to effectively extend actuation of conventional switches far beyond the distances currently possible.

It is an object of the present invention to provide an economical device which can easily be incorporated into machines with movable internal components to provide an optimal safety interlock switch mechanism which takes into consideration both safety and the practical demands of individual machines which may require more travel distances in its interlock switch.

It is a further object of the present invention to provide an improved safety interlock switch for decreasing the sensitivity required to deactivate the internal moving components in machines with excessive vibrations or machines which have internal workings which tend to inadvertently activate interlock switch mechanisms through their specific activity.

Other objects and improvements will be apparent to those skilled in the art in the following disclosure.

SUMMARY OF THE INVENTION

A conventional interlock switch system utilizes an ordinary contact switch which is mounted onto the body of a machine with moving internal elements. When a cover, which shields the internal moving elements, comes into contact with the switch, the switch completes electrical circuitry which provides power to move the internal elements; when the cover breaks contact with the switch, all internal elements cease motion with the break in electrical circuitry. The conventional contact switch has a travel of approximately 1/25 to 1/16 of an inch before this deactivation.

The safety interlock switch system of the present invention adds to a conventional contact switch, a button, a cylindrical casing, a plurality of coil springs within the cylindrical casing, and an elongated plunger. Basically, the resistance in the form of compressed tension inherent in the coil springs provide an increase in travel for the contact switch before deactivation.

When a cover, which shields the internal moving elements, comes into contact with the elongated plunger, the plunger compresses the springs against the button which activates the contact switch and electrically activates the internal mobile elements. When the cover breaks contact with the elongated plunger, the internal moving elements of the machine only shut off when the springs have completely played out the length of travel provided by the coiled tension in the compressed springs. When the compressed tension is finally played out, pressure on the button is released which deactivates the contact switch and the electric current. The uncoiling of the springs as the pressure on the plunger is released, provides extra travel above and beyond the travel provided by the contact switch alone.

The preferred embodiment utilizes a single coil spring with approximately $\frac{3}{8}$ of an inch travel. This single spring alone provides vastly more play than the 1/25 to 1/16 of an inch travel in conventional contact switches that are currently used as interlock switches. Since the coiled tension provided by the resistance of the springs against the plunger creates the increased travel distance, the amount of travel or play which is desired can be lengthened or reduced with the number of springs that are incorporated into the system; if more play is desired, more springs are added.

Other objects, features and advantages of this invention will become evident in light of the following description of the invention.

DETAILED DESCRIPTION OF THE PREFERRED EMBODIMENT

Figure 1:
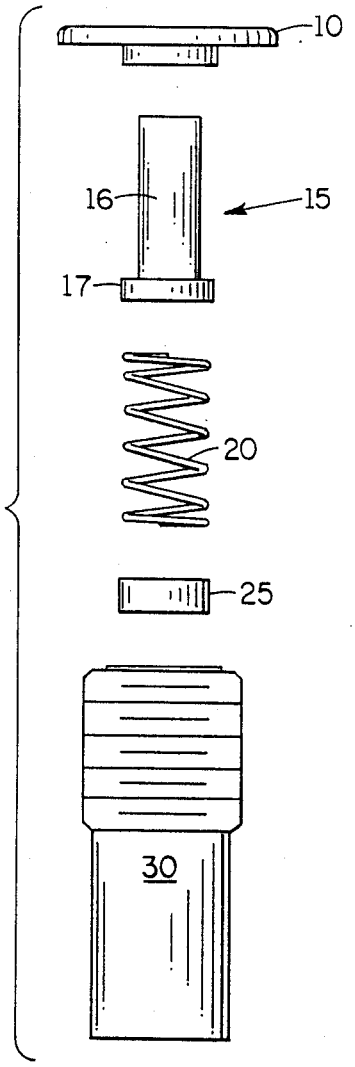
FIG. 1 depicts an exploded side view of the present invention displaying the component parts of the preferred embodiment.

Referring to FIG. 1, an exploded side view of the preferred embodiment of the present invention is shown. Flange collar 10 is manufactured with a bordering edge at its centermost portion such that shaft 16 of elongated plunger 15 is insertable through said bordering edge. The bordering edge in the center of flange collar 10 forms an opening large enough for shaft 16 to pass through but smaller than base portion 17 of plunger 15, so that base portion 17 is held back by flange collar 10 when the component parts are brought together.

Base portion 17 is designed to push against the uppermost portion of coil spring 20 within the confines of cylindrical casing body 30. The lowermost portion of coil spring 20 is designed to push against button 25. Button 25 is manufactured in a size suitable to be recessed within the confines of cylindrical casing body 30.

Figure 2:
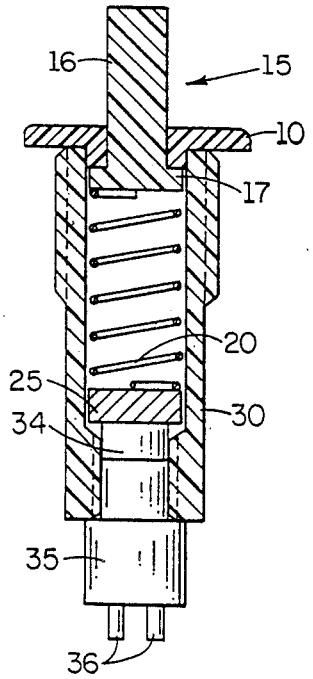
FIG. 2 is a sectional side view displaying the internal relationship of the component parts of the preferred embodiment after assembly.
Figure 3:
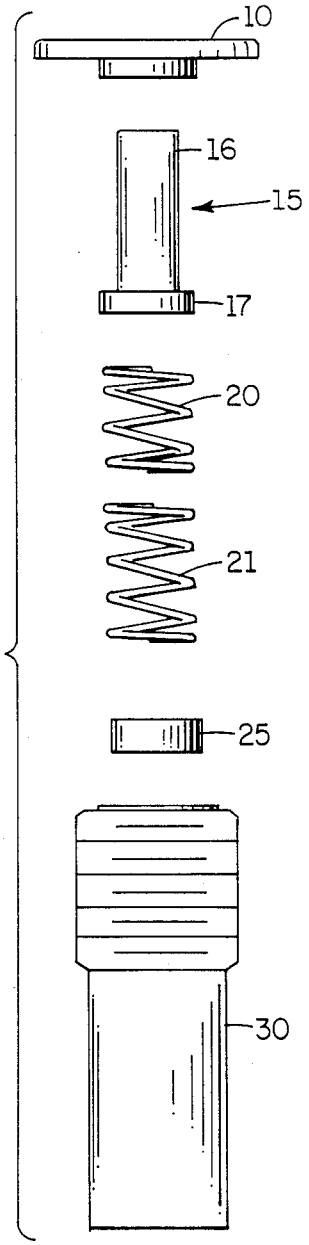
FIG. 3 depicts an exploded side view of one embodiment showing multiple springs.

Referring to FIG. 2, the internal component arrangement of the preferred embodiment after assembly is depicted in a sectional side view. Cylindrical casing body 30 has, at an uppermost portion, external threading which engages flange collar 10. This engagement holds flange collar 10 against the base portion 17 of plunger 15 such that elongated shaft portion 16 protrudes out of said casing body 30 through flange collar 10, while circular base portion 17 remains within casing body 30.

Circular base portion 17 of plunger 15 sits adjacent the uppermost portion of coil spring 20, while the lowermost portion of coil spring 20 rests adjacent a first face of button 25. A second face of button 25 rests adjacent operator 34 of contact switch 35. Contact switch 35 is threadably engaged to casing body 30. When pressure is exerted on elongated shaft portion 16 of plunger 15, base portion 17 compresses against the uppermost portion of coil spring 20. When sufficient tension has overcome the compressive resistance of coil spring 20, the lowermost portion of coil spring 20 pushes against the first face of button 25. The second face of button 25 exerts pressure on contact switch 35 which activates electrical circuitry in an electric system connected to electric leads 36.

When used as a safety interlock switch mechanism, the entire apparatus depicted in FIG. 2 is mounted into the body of a suitable machine such that the cover which shields the internal moving components of this machine makes contact with the elongated shaft portion 16 of plunger 15. When the cover is placed in a closed position plunger 15 compresses spring 20 against button 25 activating contact switch 35. The internal moving components are, thus, able to begin mobile operation. When the cover is moved away, either intentionally removed or inadvertently shifted out of position, the pressure on contact switch 35 is not limited to the travel distance inherent in the contact switch. The compressed tension of coil spring 20 provides additional travel such that deactivation is either delayed or prevented until the entire travel of coil spring 20 is played out.

The delay in deactivation provided by coil spring 20 allows the internal moving components to remain in motion even if the cover is inadvertently shifted out of position as, for example, by vibrations caused by the machine.

Thus, the present invention is well-suited to carry out the objects and attain the ends and advantages mentioned above as well as those inherent therein. While the preferred embodiment of the present invention has been described for the purposes of this disclosure, changes in the design and arrangements of features can be made by those skilled in the art, which changes are encompassed within the spirit of this invention as defined by the appended claims.

What is claimed is:

1. A safety interlock switch system comprising:

a hollow elongated case having a cavity therein;

a flange collar with a centrally situated bordering edge, within said cavity of said flange collar threadably engaged to said elongated case;

a plunger comprising an elongated shaft portion and a base portion such that said flange collar holds said plunger at said base portion within said cavity with said elongated shaft protruding through said bordering edge;

at least one coil spring disposed within said cavity such that said base portion of said plunger rests adjacent a first end of said coil spring;

a button member disposed within said cavity, said button member having a first surface and a second surface, said first surface of said button member rests adjacent a second end of said coil spring; and an electric contact switch threadably engaged to said elongated case, said contact switch resting adjacent said second face of said button member such that when pressure is applied to said shaft portion of said plunger, said base portion compresses against said coil spring, said coil spring compresses against said button, and said button activates said contact switch.

2. The safety interlock switch system of claim 1 further comprising plurality of coil springs disposed end to end within said cavity.

* * * * *